US007260852B2

(12) United States Patent
Sheetz

(10) Patent No.: US 7,260,852 B2
(45) Date of Patent: Aug. 28, 2007

(54) WRAPAROUND SWIMSUIT

(76) Inventor: Dianne Rothhammer Sheetz, 5500 Calle Real Apt. B-319, Santa Barbara, CA (US) 93111-3610

( * ) Notice: Subject to any disclaimer, the term of this patent is extended or adjusted under 35 U.S.C. 154(b) by 0 days.

(21) Appl. No.: 11/146,793

(22) Filed: Jun. 7, 2005

(65) Prior Publication Data

US 2006/0272069 A1 Dec. 7, 2006

(51) Int. Cl.
*A41D 5/00* (2006.01)

(52) U.S. Cl. ..... 2/67; 2/104; 2/114

(58) Field of Classification Search ..... 2/67, 2/115, 104, 114, 69
See application file for complete search history.

(56) References Cited

U.S. PATENT DOCUMENTS 1,909,279 A * 5/1933 Just ..... 2/67
1,987,009 A * 1/1935 Hall ..... 2/115
2,028,602 A * 1/1936 Hanson ..... 604/388
2,377,004 A * 5/1945 Hanes ..... 2/78.1
D157,777 S * 3/1950 Thunstedt ..... D27/149
2,734,194 A * 2/1956 Colvin ..... 2/80
3,348,237 A * 10/1967 Simonoff ..... 2/74
3,840,900 A * 10/1974 Cruz ..... 2/77
4,144,593 A * 3/1979 Timmons ..... 2/104
4,421,117 A * 12/1983 Klausen et al. ..... 450/131
4,656,669 A * 4/1987 Beard ..... 2/67
4,688,270 A * 8/1987 Denicola et al. ..... 2/102
4,815,145 A * 3/1989 Chow ..... 2/67
5,033,121 A * 7/1991 Larsen ..... 2/229
5,062,159 A * 11/1991 Jakub ..... 2/114
5,083,316 A * 1/1992 Kuehner ..... 2/67
5,088,117 A * 2/1992 Fulmer ..... 2/114
5,097,536 A * 3/1992 Cohen ..... 2/114
5,189,736 A * 3/1993 Price ..... 2/69
5,561,858 A * 10/1996 Poirier ..... 2/67
5,717,998 A * 2/1998 Everett et al. ..... 2/67
5,772,492 A * 6/1998 Erwin ..... 450/30
6,016,569 A * 1/2000 Everett et al. ..... 2/67
6,035,439 A * 3/2000 Chin ..... 2/67
6,243,871 B1 * 6/2001 Fidler ..... 2/80
D512,205 S * 12/2005 Alexander et al. ..... D2/841
D517,777 S * 3/2006 Thunstedt ..... D2/731

* cited by examiner

*Primary Examiner*—Alissa Hoey
*Assistant Examiner*—Jena A Sold
(74) *Attorney, Agent, or Firm*—Brinks Hofer Gilson & Lione

(57) ABSTRACT

A swimsuit especially adapted for use by elderly and physically challenged women includes a one-piece body having an upper wraparound portion and a lower trunk portion. The upper portion includes first and second panels or flaps that overlap one another and include free ends that are secured to the body by readily securable and releasable fasteners such as hook and loop fasteners.

17 Claims, 4 Drawing Sheets

WRAPAROUND SWIMSUIT

BACKGROUND

The invention relates generally to swimsuits for women and more particularly to a wraparound swimsuit for elderly and physically challenged women.

For many years the benefits of swimming for exercise and health maintenance have been recognized. The low impact, low stress environment provided by the water and the constant, relatively low resistance it provides to movement of the limbs achieves recognized aerobic (heart and circulatory system) and muscle strengthening benefits.

The benefits provided by swimming are especially significant to the elderly and physically challenged particularly and primarily due to the limited number of exercise choices available thereto. Even those suffering from arthritis, Parkinson's disease or muscular dystrophy may exercise in the water and achieve health benefits.

One of the more problematic challenges of such activity, however, is the donning and removal of swimming apparel, that is, a swimsuit. As virtually all swimmers know, the problem of swimsuit removal is particularly vexing when the suit is wet, after completion of a swim or exercise session.

The present invention successfully addresses this problem and provides a swimsuit which is simple, attractive and readily donned and removed.

SUMMARY

A swimsuit especially adapted for use by elderly and physically challenged women includes a one-piece body having an upper wraparound portion and a lower trunk portion. The upper portion includes first and second panels or flaps that overlap one another and include free ends that are secured to the body by readily securable and releasable fasteners such as hook and loop fasteners.

It is thus an object of the present invention to provide a swimsuit for female swimmers which may be readily donned and removed.

It is a further object of the present invention to provide a swimsuit for female swimmers which may be readily donned and removed even when wet.

It is a still further object of the present invention to provide a wraparound swimsuit for elderly and physically challenged female swimmers.

It is a still further object of the present invention to provide a wraparound swimsuit having first and second panels which are secured by hook and loop fasteners.

Further object and advantages of the present invention will become apparent by reference to the following description of the preferred embodiment and appended drawings wherein like reference numbers refer to the same component, element or feature.

DESCRIPTION

Figure 1:
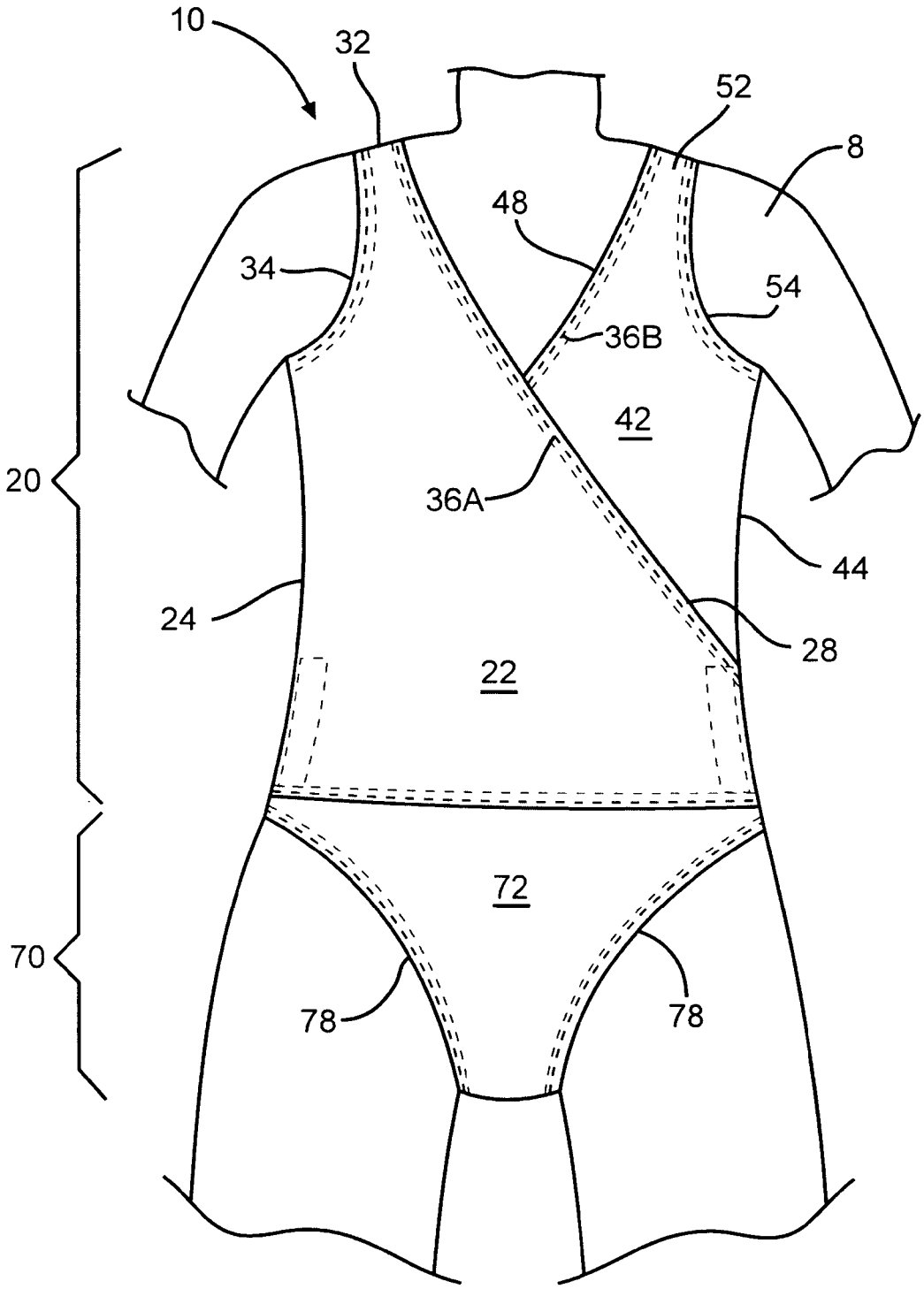
FIG. 1 is a front, elevational view of a typical swimmer wearing a wraparound swimsuit according to the present invention.

Referring now to FIG. 1, a wraparound swimsuit according to the present invention is illustrated on a person 8 and is generally designated by the reference number 10. The wraparound swimsuit 10 may be characterized as a single piece or one piece bathing suit or swimsuit and comprises a first or upper bodice portion 20 and a second or lower trunk portion 70.

Figure 2:
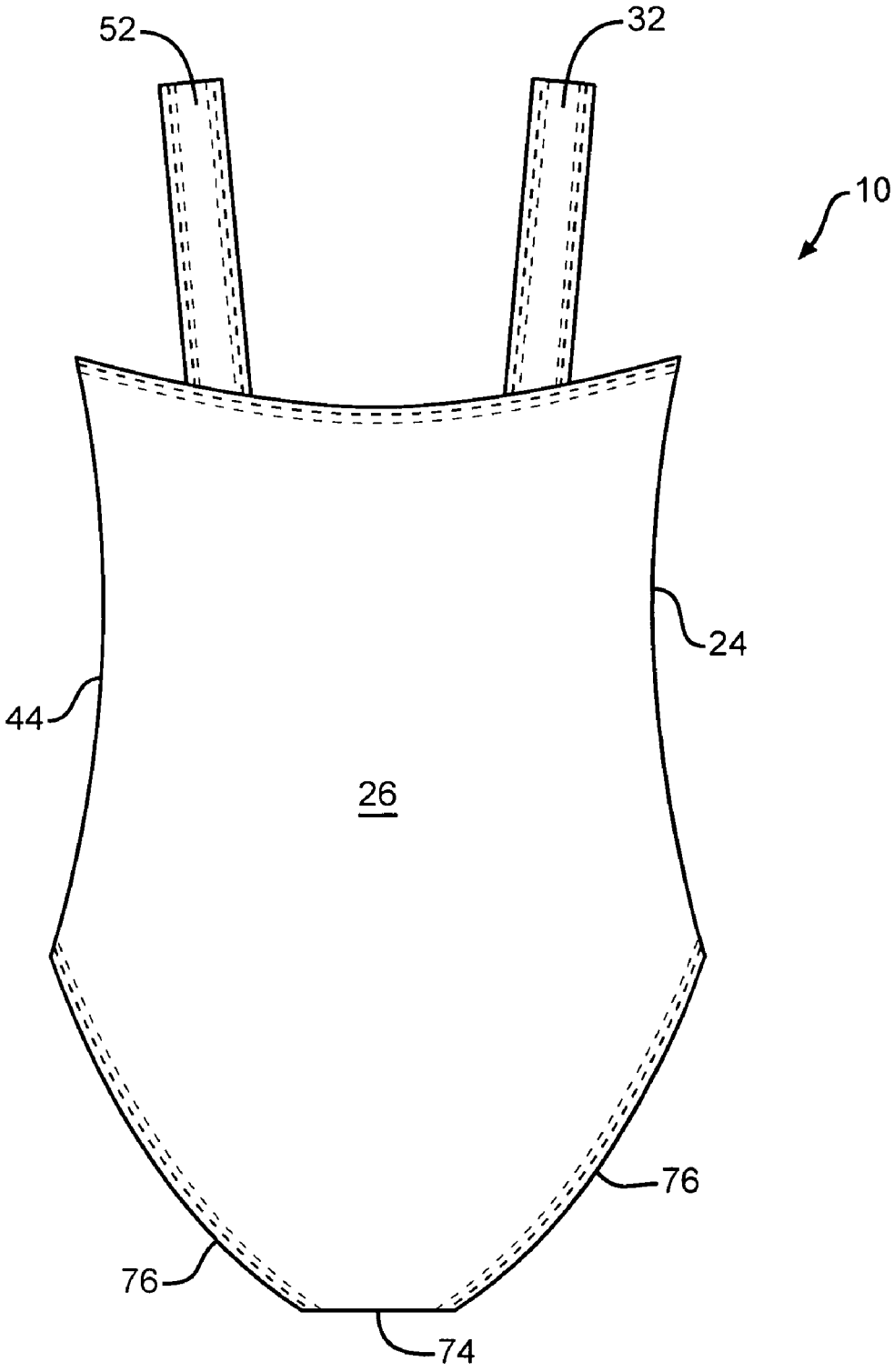
FIG. 2 is a rear, elevational view of a wraparound swimsuit according to the present invention.

Referring now to FIGS. 1 and 2, the first or upper bodice portion 20 includes a generally triangular right front panel 22 which is sewn or secured along a generally vertical edge or seam 24 to a unitary back panel 26. The right front panel or flap 22 narrows in an upward direction along a frontal diagonal edge 28 to a relatively wide right strap 32 which engages a wearer's right shoulder. The right strap 32 continues down the wearer's back and is secured by sewing, stitching or other suitable means to the back panel 26. The right front panel or flap 22 also defines an upper curved marginal edge 34 which defines a forward portion of an arm or shoulder opening for the right arm of the wearer. It will be appreciated that all open or exposed edges are preferably rolled or folded and sewn or stitched with similar, complementary or contrasting white or colored thread 36A.

Figure 3:
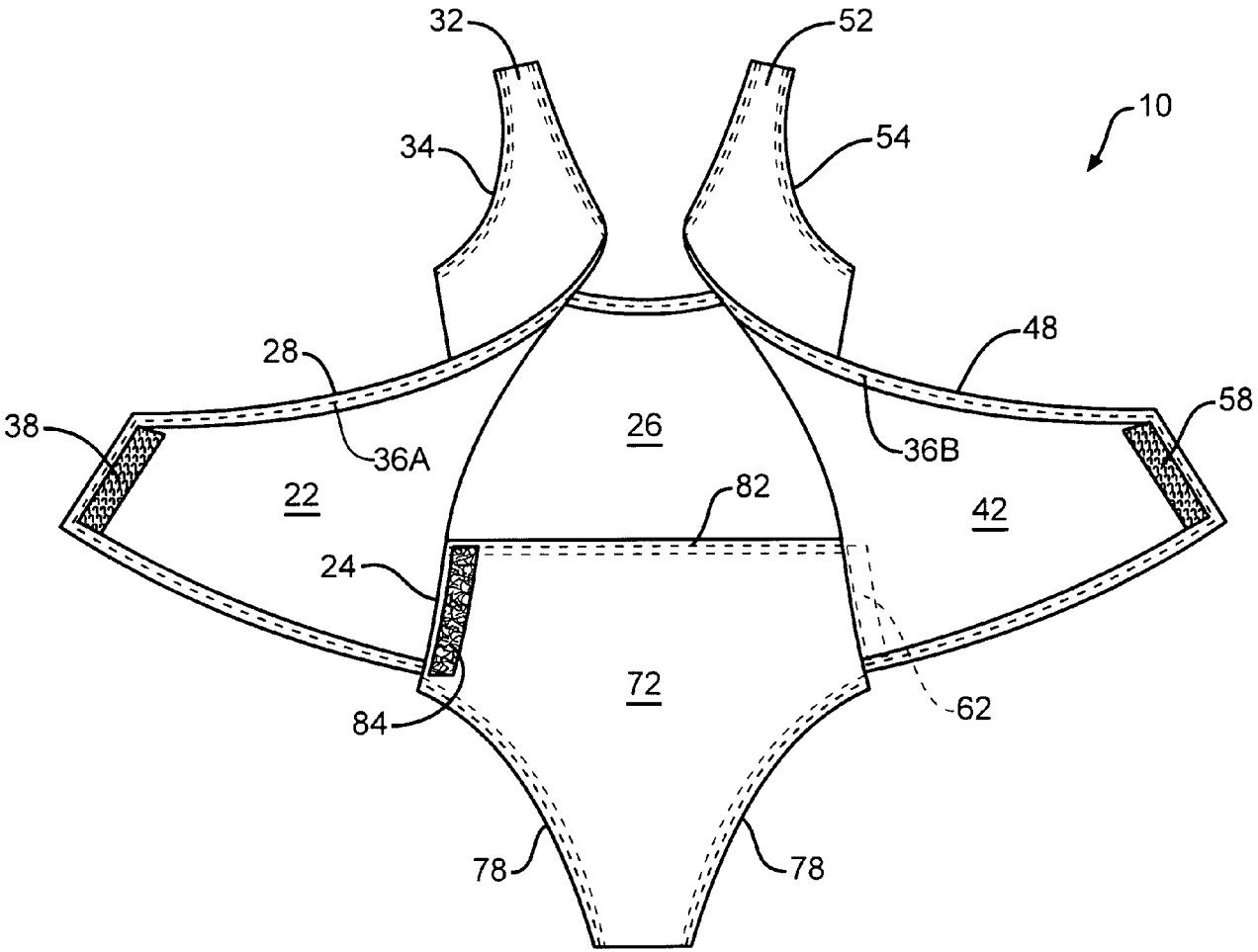
FIG. 3 is a front, elevational view of a wraparound swimsuit according to the present invention with both first and second panels opened.

Referring now to FIG. 3, on the inside face of the lower end of the right front panel or flap 22 is a vertically elongate pad or region 38 of a hook or loop fastening material such as Velcro. Velcro is a registered trademark of Velcro Industries, B.V. Preferably, the hook portion of the hook and loop fastener resides on the inside end of the right front panel 22.

Referring now to FIGS. 1 and 3, the first or upper bodice portion 20 of the swimsuit 10 also includes a left front panel or flap 42 having an overall configuration which is a mirror image of the right panel or flap 22. The left front panel or flap 42 is generally triangular and is sewn or secured along a generally vertical edge or seam 44 to the unitary back panel 26. The left front panel or flap 42 narrows in an upward direction along a frontal diagonal edge 48 to a relatively wide left strap 52 which engages a wearers left shoulder. The left strap 52 continues down the wearer's back and is secured by sewing, stitching or other suitable means to the back panel 26. The left front panel 42 also defines an upper curved marginal edge 54 which defines a forward portion of an arm or shoulder opening for the left arm of the wearer. It will be appreciated that, as noted, all open or exposed edges are preferably rolled or folded and sewn or stitched with similar, complementary or contrasting white or colored thread 36B. On the inside face of the lower end of the left front panel or flap 42 is a vertically elongate region or pad 58 of a hook or loop fastening material such as Velcro. Preferably, the hook portion of the hook and loop fastener resides on the inside end of the left front panel 42.

It will be appreciated that forward inserts, resilient cups, padding and the like (all not illustrated) may be secured at appropriate locations on the inside of the panels or flaps 22 and 42 to provide breast support for the user or for cosmetic or aesthetic reasons.

Figure 4:
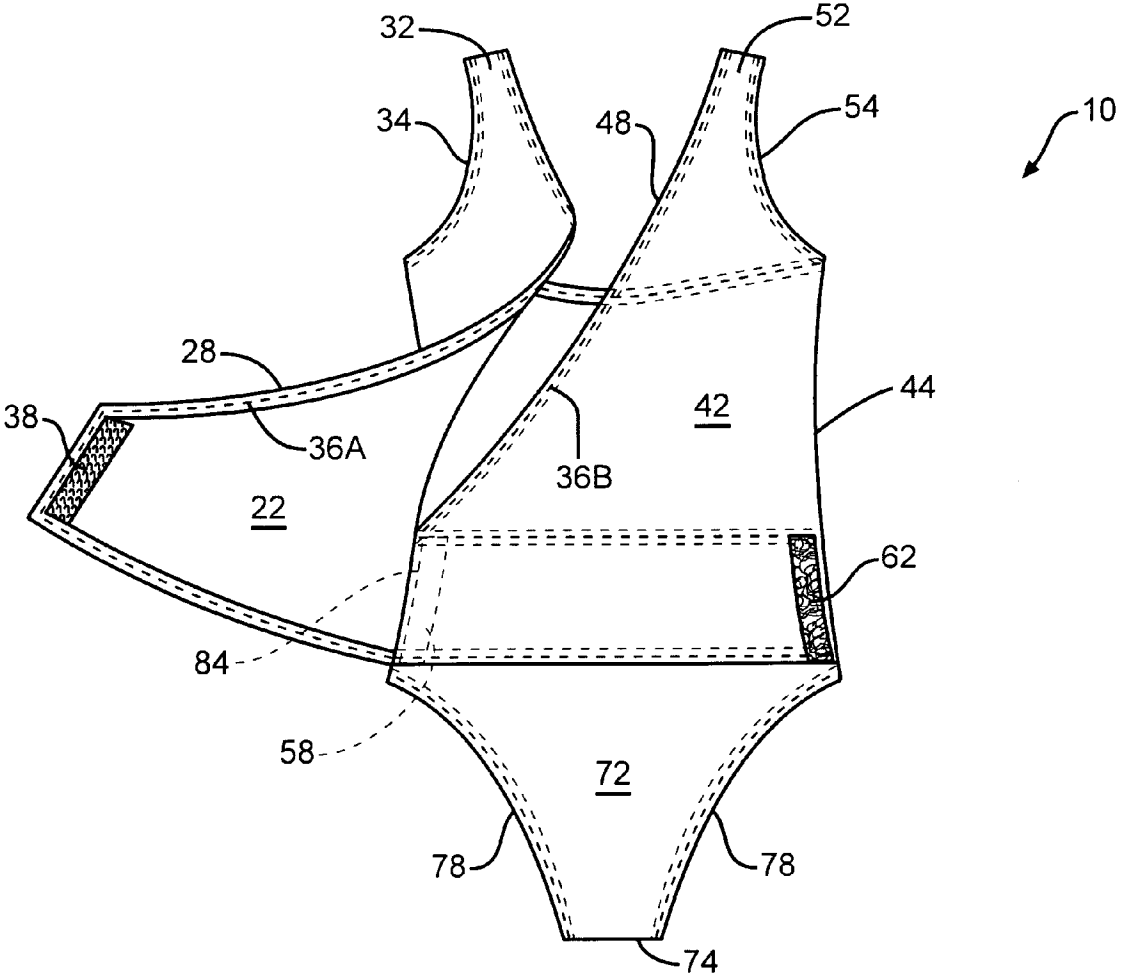
FIG. 4 is a front elevational view of a wraparound swimsuit according to the present invention with one panel secured in place and the other panel open.

Referring now to FIG. 4, on the left outside face of the left panel or flap 42 adjacent the left seam 44 is region or pad 62 of a hook and loop fastener such as Velcro. Preferably, the pad 62 is the loop portion of the hook and loop fastener.

Referring now to FIGS. 1, 2, 3 and 4, the swimsuit 10 also includes the lower or trunk portion 70 which includes a front panel 72 which is secured along a transverse lower seam 74 and right and left side seams 24 and 44 to the lower portion of the back panel 26, forming an unopenable crotch portion. The lower portion of the back panel 26 includes two symmetrical convexly curved marginal edges 76 which are generally cut or configured to cover the buttocks (not illustrated) of the wearer. The front panel 72 includes concave marginal edges 78 which are cut or configured primarily for comfort. Just as with the front panels 22 and 42 of the upper or bodice portion 20, the open or exposed edges of the lower or trunk portion 70 are rolled or folded and secured by sewing or stitching 82 with thread having matching, contrasting or complementary color. On the right side of the front panel 72 adjacent the side seam 24 is secured an elongate, vertically orientated region or pad 84 of a hook and loop material such as Velcro. Preferably, the pad 84 is of the loop type material.

The various panels of the wraparound swimsuit 10 are preferably of four way stretch Lycra fabric. Lycra is a registered trademark of INVISTA. It will be appreciated that other materials and fabrics, both natural and synthetic, may, however, be utilized if desired.

In use, the swimsuit 10 may be readily donned and removed. The user 8 steps into the lower or trunk portion 70 and places left and right legs in the openings defined by the edges 76 of the back panel 26 and the edges 78 of the front panel 72. The user then places the left and right straps 32 and 52 over their respective shoulders. Next, the left panel or flap 42 is placed across the front of the body and the hook and loop fastener pads 58 and 84 are aligned, engaged and secured together. Last of all, the right panel or flap 22 is placed across the left panel or flap 42 and the hook and fastener pads 38 and 62 are aligned, engaged and secured together.

After swimming or exercise, this simple procedure is reversed and the swimsuit 10 may be readily removed.

It will be appreciated that a significant reduction in the surface area of the swimsuit 10 which must be slid on and off the body, essentially the entire upper or bodice portion 20, greatly reduces the effort necessary to don, and particularly the effort necessary to remove, the wet swimsuit 10.

The foregoing disclosure is the best mode devised by the inventor for practicing this invention. It is apparent however, that devices incorporating modifications and variations will be obvious to one skilled in the art of wraparound swimsuits. Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

I claim:

1. A wraparound swimsuit comprising, in combination, a bodice portion having a back panel, a first front panel and a second front panel, said first front panel secured to said back panel, having a first shoulder strap attached to said back panel and a first terminal portion including a first one of a hook and loop fastening device, said second front panel secured to said back panel, having a second shoulder strap attached to said back panel and a second terminal portion including a second one of a hook and loop fastening device, said second front panel additionally having a third one of a hook and loop fastening device adjacent the back panel and disposed to engage said first one of a hook and loop fastening device, and a trunk portion including a portion of said back panel, a front panel and an unopenable crotch portion, said front panel and said portion of said back panel being stitched together along lower side seams and defining leg openings, said trunk portion having a fourth one of a hook and loop fastening device disposed to engage said second one of a hook and loop fastening device.

2. The wraparound swimsuit of claim 1 wherein said first and said second front panels are generally triangular.

3. The unitary wraparound swimsuit of claim 1 wherein said front panels are joined to said back panel along respective vertical seams.

4. The wraparound swimsuit of claim 1 wherein said back and front panels and said trunk include folded and stitched edges.

5. The wraparound swimsuit of claim 1 wherein said panels are made of a multiple axis stretch material.

6. A swimsuit comprising, in combination, an upper portion having a back panel, a right front panel and a left front panel, said right front panel extending from a right side of said back panel and having a right front panel inside surface, a right front panel outside surface and a frontal oblique edge defining a right shoulder strap at one end and a left terminal portion at the other end, said right front panel inside surface having a first fastener at said left terminal portion, said left front panel extending from a left side of said back panel and having a left front panel inside surface, a left front panel outside surface and a frontal oblique edge defining a left shoulder strap at one end and a right terminal portion at the other end, said left front panel inside surface having a second fastener at said right terminal portion, said left front panel outside surface having a third fastener adjacent said left side of said back panel, and a lower portion having a right side and a left side, defined by a lower front panel, a lower portion of said back panel and an unopenable crotch portion, said lower front panel and said lower portion of said back panel stitched together along lower side seams, said lower front panel including a fourth fastener located on the right side of said lower portion, wherein the first fastener is adapted to engage the third fastener and the second fastener is adapted to engage the fourth fastener.

7. The swimsuit of claim 6 wherein said fasteners are hook and lop fasteners.

8. The swimsuit of claim 6 wherein said first and second fasteners are hook fasteners of hook and loop fasteners.

9. The swimsuit of claim 6 wherein said third and fourth fasteners are loop fasteners of hook and loop fasteners.

10. The swimsuit of claim 6 wherein said right and left front panels are generally triangular.

11. The swimsuit of claim 6 wherein said front panels are secured to said back panel along respective side seams.

12. The swimsuit of claim 6 wherein said panels are multiple axis stretch fabric.

13. A wraparound swimsuit comprising, in combination, a back panel defining an upper portion and a lower portion, a trunk portion including said lower portion of said back panel, a front panel and an unopenable crotch portion, said lower portion of said back panel and said front panel stitched together along lower side seams and defining a pair of leg openings, a bodice portion including said upper portion of said back panel and a first front panel, having a first inside surface and a first outside surface, secured to said back panel, defining a first shoulder strap attached to said back panel and including a first terminal portion having a first one of a hook and loop fastener on said first inside surface, a second panel, having a second inside surface a second outside surface, secured to said back panel, defining a second shoulder strap attached to said back panel and including a second terminal portion having a second one of a hook and loop fastener on said second inside surface, a third one of a hook and loop fastener disposed on said second outer surface second for engagement with said first one of a hook and loop fastener, and a fourth one of a hook and loop fastener disposed on the trunk portion for engagement with said second one of said hook and loop fastener.

14. The wraparound swimsuit of claim 13 wherein said first and said second ones of hook and loop fasteners are loop portions of hook and loop fasteners.

15. The wraparound swimsuit of claim 13 wherein Said first and said second front panels are generally triangular.

16. The wraparound swimsuit of claim 13 wherein said first and second front panels are secured to said back panel along respective vertical seams.

17. The wraparound swimsuit of claim 13 wherein said bodice and trunk portions are multiple axis stretch fabric.

* * * * *